US005152331A

United States Patent [19]

Barone

[11] Patent Number: 5,152,331

[45] Date of Patent: Oct. 6, 1992

[54] NO-SEW WINDOW TREATMENT

[76] Inventor: Dana A. Barone, 1155 Walter Blvd., Manahawkin, N.J. 08050

[21] Appl. No.: 809,650

[22] Filed: Dec. 16, 1991

[51] Int. Cl.[5] ..... E06B 9/00

[52] U.S. Cl. ..... 160/38; 160/19

[58] Field of Search ..... 160/39, 38, 19, 178.1, 160/902, 330; 16/94 D, 94 R, 95 D; 248/262, 267, 264

[56] References Cited

U.S. PATENT DOCUMENTS

| | | | |
|---|---|---|---|
| 2,501,133 | 3/1950 | Levy | 160/38 X |
| 2,998,062 | 8/1961 | Bixby | 160/39 |
| 3,643,288 | 2/1972 | Olivari | 16/95 D |
| 4,999,874 | 3/1991 | White | 16/95 D |
| 5,033,525 | 7/1991 | Paeselt | 160/19 X |

*Primary Examiner*—Blair M. Johnson

*Attorney, Agent, or Firm*—Charles I. Brodsky

[57] ABSTRACT

The no-sew window treatment of the invention comprises a form of semi-soft foam which is covered by fabric through a wrap and tuck process. The form incorporates a straight slit cut into an exterior surface running along its entire length. The form additionally incorporates a cross-shaped slot running through its center, also along its entire length. The fabric employed is wrapped around the form, cut to the length desired, and its ends are then fitted into the straight slit; the sides of the fabric are then tucked into the cross-shaped slot. Because of the semi-soft characteristics of the foam, and the close-fit force exerted on the ends and sides of the fabric, the result is to provide a form which holds the fabric in place—yet, one which is easy to install, cover and assemble (even by the purchaser) and without the need for any sewing to give a customized look.

12 Claims, 5 Drawing Sheets

NO-SEW WINDOW TREATMENT

FIELD OF INVENTION

This invention relates to styles for decorating or covering windows and, more particularly, to treatment styles for creating valance, cornice and "topper" arrangements simply and inexpensively.

BACKGROUND OF THE INVENTION

As is well known and understood, window treatment stylings and installations are typically handled by a professional designer. The styling and installation required to create a custom valance or cornice is a relatively complex matter, and requires years of experience in order for the treatment to present the look desired. Regardless of the type of design intended, a craftsman having years of experience is usually employed to carry out the decoration or covering desired, and at the high fees and charges which they can typically demand. It would obviously be advantageous, therefore, if a new and unique manufacture were available to make these installations more cost effective, and to provide a "custom look" easily and inexpensively.

SUMMARY OF THE INVENTION

As will become clear in the description that follows, the window treatment of the present invention accepts the same types of coverings as now available in the industry, and to allow for a multiplicity of designs, by combining different shapes and different decorative hardware. As will also be seen, the window treatment will be easy to cover and assemble, and, perhaps more importantly, easier to install, allowing measurements to be made at the job location, if necessary. As will also become clear from the description below, the window treatment of the invention is reusable, allowing an easy change of fabric coverings and/or a re-use of shapes and forms—all in an easy, fast, and inexpensive manner for assembling and reassembling the treatment at hand. As will also become apparent, the window treatment of the invention can be accomplished by the purchaser (at home), or by a designer (in a retail/studio setting), or in a work room (where it could be pre-wrapped as a style to be generally available and ordered when wanted).

More particularly, and as will be seen from the description below, the window treatment of the invention follows from the use of a form of semi-soft foam which is covered by fabric through a wrap and tuck process. The form utilized will be seen to incorporate a straight-slit cut into an exterior surface running along its entire length, along with a cross-shaped slot running through its center, also along that length. The fabric employed will be seen to be wrapped around the form, cut to the length desired, with its ends fitted into the straight slit—and with its sides then being tucked into the cross-shaped slot. Because of the semi-soft characteristics of the foam, and with the slit being of an opening to accept the opposing ends of the fabric in a close fit, the end result is to provide a form which holds the fabric in place. And, because of these characteristics, the window treatment can thus be completed without the need for any "sewing" whatsoever, so as to provide a customized look easily and inexpensively.

As will also be seen, by using such a window treatment of the invention, it then becomes possible—and as will be more fully described below, to design the treatment, to wrap, tuck and cap the form, as well as to connect forms together, combine different forms as desired, and to otherwise deal with the treatments in creating modern, traditional, or other arrangements according to the preferences of the owner or tenant.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
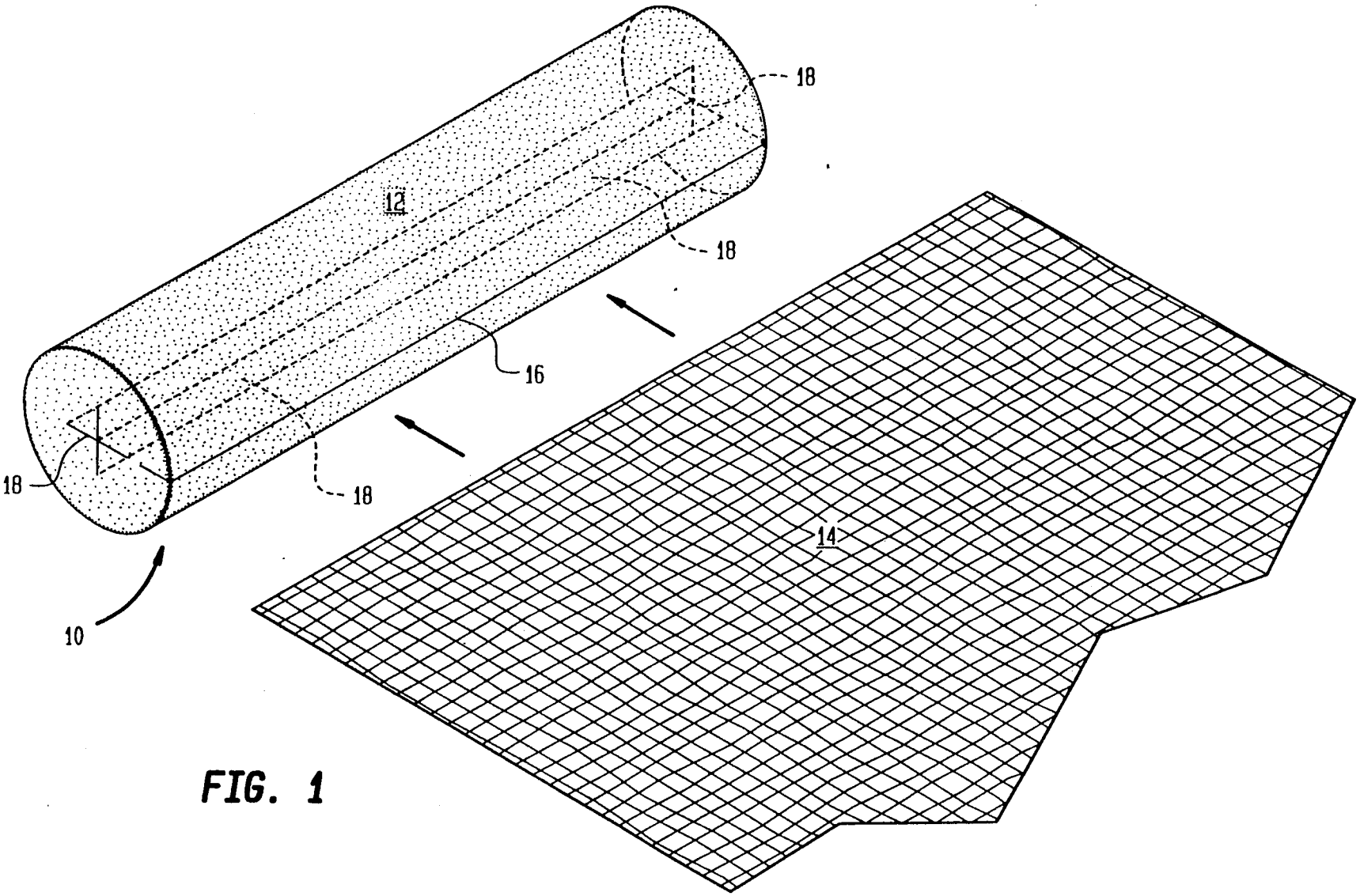
FIG. 1 is a perspective view of semi-soft form of predetermine, shape and dimension, helpful in an understanding of the invention.
Figure 2C:
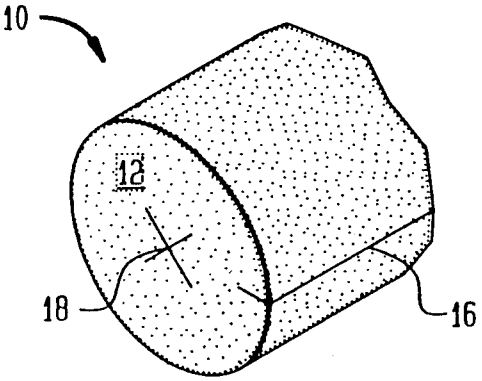
FIG. 2A–2D illustrate the shapes of various forms that can be utilized in accordance with the invention.
Figure 2D:
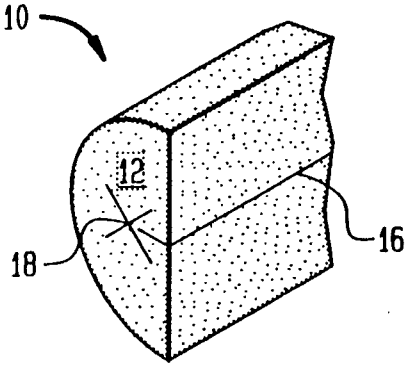
Figure 2A:
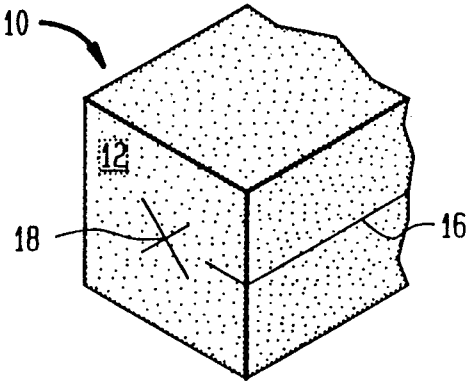
Figure 2B:
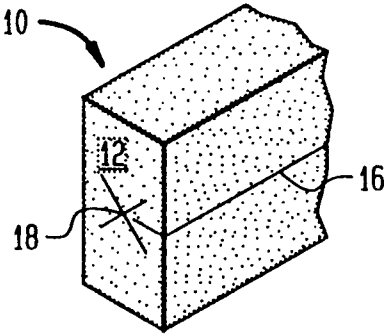
Figure 3:
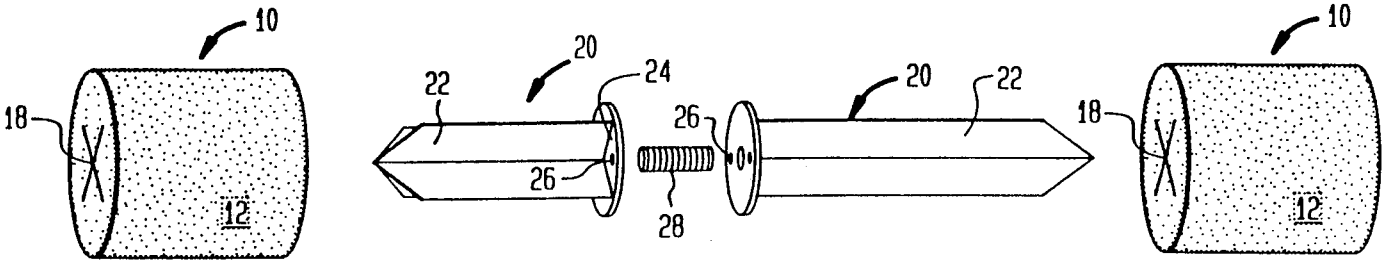
FIG. 3 shows a manner of joining two typical forms together in developing a window treatment according to the invention.

Referring now more particularly to FIGS. 1–3, reference numeral 10 identifies a form of semi-soft foam 12 of predetermined shape and dimension, cut to any length desired, either by the purchaser of the form, or by the designer of the window treatment or by the manufacturer of pre-arranged treatments. As illustrated, such form may be of square (FIG. 2A), rectangular (FIG. 2B), circular (FIG. 2C), or semi-circular (FIG. 2D) cross-section around which a fabric 14 is to be wrapped and tucked. To facilitate this, a straight-slit 16 is cut into an exterior surface of the foam 12, running along its entire length. Also shown is a slot 18 which also runs along the entire length of the foam along its central axis, and of an "X" or cross-shape in a preferred embodiment. In accordance with the invention, the fabric 14 is cut to size, and wrapped around the foam 12 such that its opposite ends are available to be inserted into the straight slit 16, while the opposite sides of the fabric 14 are available to be tucked into the cross-shaped slot 18 running through the foam center. While this can easily be done by hand, the use of a "stake" or similar such tool can be utilized to more easily tuck the sides into the slot 18, and to then rotate the stake in tightening the fabric 14 against the exterior surface of the foam 12. Such a stake is shown at 20 in FIGS. 3–5, and will be more completely described below. But, by employing a semi-soft foam—of polyethylene, for example, and of a polyethylene employed in packaging and industrial use, in particular—the fabric 14 will be held in place, flatly secured against the shape of the foam 12, and held there especially when the slit 16 is selected of an opening to accept the opposing ends of the fabric in a close fit.

Such polyethylene may have a density of between 1.5 and 4.5 pounds per cubic foot, and able to withstand a compressive force of between 3 and 19 pounds per square inch.

As will be appreciated, such form requires no sewing to hold the fabric in place, can be cut to measure and can be easily disassembled to change fabric coverings as desired at later times.

As will be apparent, some window treatment stylings might require the individual forms or shapes to be secured together in creating a multitude of designs. To such end, a pair of stakes 20 can be utilized (as in FIG. 3, for example) each with its own shank 22 and with its own flat plate 24. As will be seen, the flat plate 24 is provided with one or more holes 26, to accept, for example, a headless bolt 28 in joining the stakes 20 together back-to-back (FIG. 3). The shank 22 is fluted, in this construction, of a "X" cross-section to fit into the slot 18 of the form 10 into which it is inserted, with the stake 20 then being rotated within the slot 18 to tighten-up on the fabric 14 which has previously been tucked into position. Such an arrangement will obviously be advantageous in extending across the window to be covered.

Figure 4:
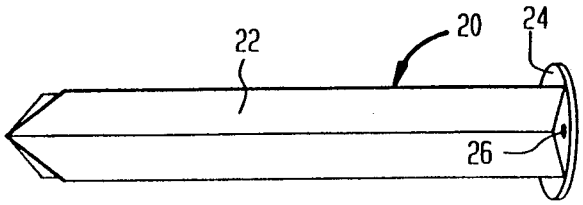
FIGS. 4 and 5 are helpful in an understanding of methods of securing the form in an installation.
Figure 5:
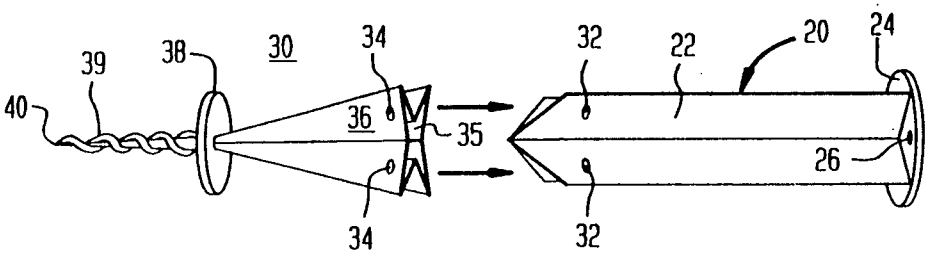
Figure 6:
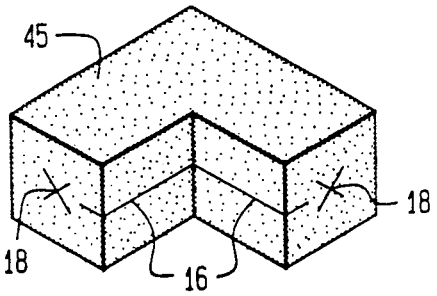
FIGS. 6–9 illustrate elbow-sections, usable in creating window treatments according to the teachings of the invention.
Figure 7:
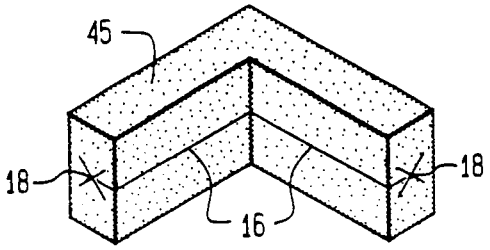
Figure 8:
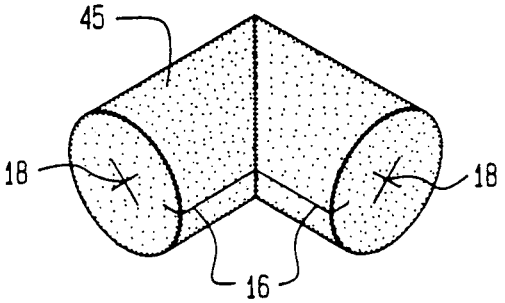
Figure 9:
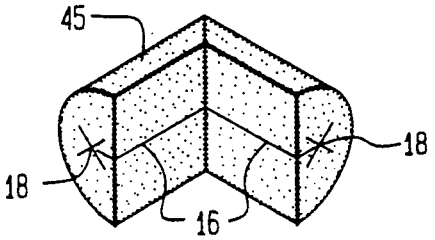

FIGS. 4 and 5 show two further methods of employing the stake 20 in the styling treatment desired. In FIG. 4, the arrangement illustrates that to be employed when installing the window treatment style directly to a wall. There, the connector stake 20 is screwed into the wall by the apertures 26 in the flat plate 24, with the pointed end, as shown, then being inserted through the interior slot 18 of the foam 12. In such construction, then, the form 10 is mounted secure in place, screwed to the wall.

In FIG. 5, on the other hand, an arrangement is depicted for installing, for example, a straight valance which does not return to the wall. There, a spiralled adaptor 30 may be utilized, with the stake 20 first being secured to the wall by the flat plate 24 along with its screw holes 26. A second set of screw holes 32 are shown, to match with a pair of similar such holes 34 in the "female end" 36 of the spiral adapter 30. As will be appreciated, the "female end" 36 receives the pointed end of the stake 20, where the two are then secured together, and out of such arrangement extends a circular support plate 38 to which a corkscrew-like projection 39 outwardly extends. With the cork-screw-like projection being in the nature of a solid spiralling twisted piece with a sharp tip 40, the projection 39 will be understood to puncture through the fabric 14 and foam 12 of the form to be secured, pushing deeper into the foam as the corkscrew 39 is turned. As will be appreciated by those skilled in the art, the back plate 38 employed lends support to the form and prevents the foam from screwing over the tip of the end 36 in the installation. Such use of the stake 20 and the spiral end attachment 30 could likewise be used anywhere along the length of an installed form, to provide added support.

Sometimes, on the other hand, the window treatment styling might employ a return that projects directly out from the wall, but in the nature of a corner elbow. As will be appreciated, such elbows finish styles directly to the wall and can be mounted onto the stake 20, in the manner depicted in FIG. 4. Such corner elbows are shown by the reference numeral 45 in the representations of FIGS. 6–9, for square, rectangular, circular and semi-circular cross-sectional foams, as illustrated. When any particular window treatment style of this type requires a further clearance from the wall, then additional lengths of the form, cut to measure, could be connected to the corner elbow 45 in a manner as in FIG. 3, where the added form would then finish at the wall in providing the additional space.

Figure 10A:
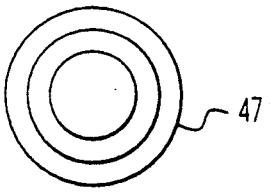
FIGS. 10–12 show decorative ornamentations for the forms of the invention, and how they may be installed.
Figure 11A:
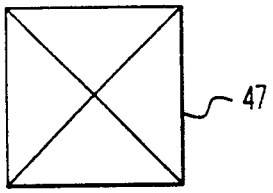
Figure 10B:
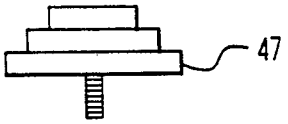
Figure 11B:
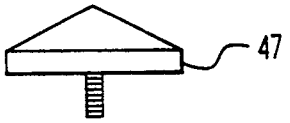
Figure 12:
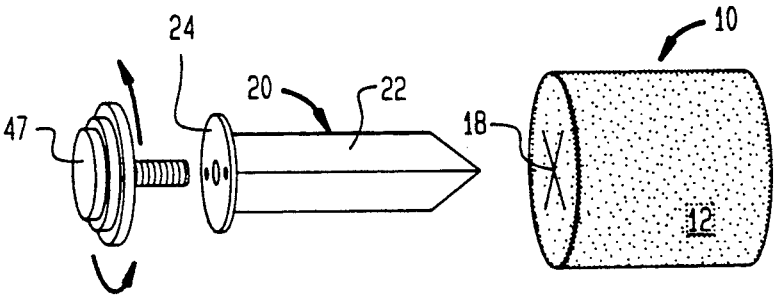
Figure 13A:
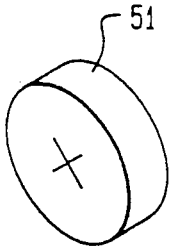
FIGS. 13*a*–16*c* are views showing how end caps may be utilized to finish off the ends of the forms constructed according to the invention.
Figure 13B:
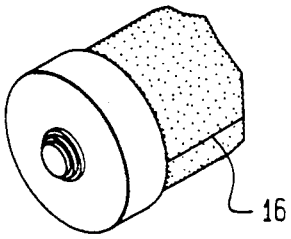
Figure 14A:
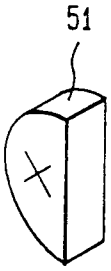
Figure 14B:
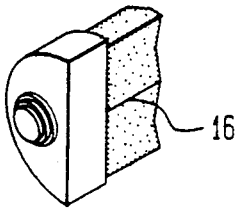
Figure 13C:
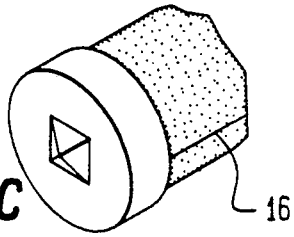
Figure 14C:
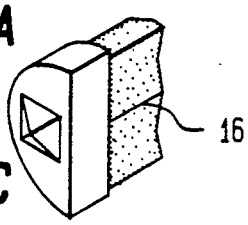
Figure 15A:
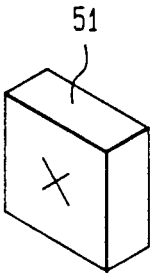
Figure 15B:
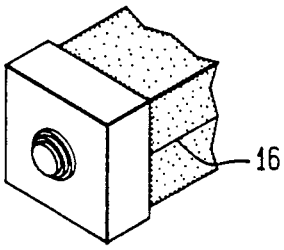
Figure 16A:
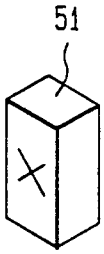
Figure 16B:
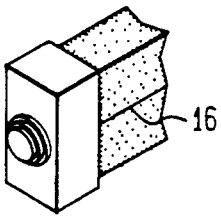
Figure 15C:
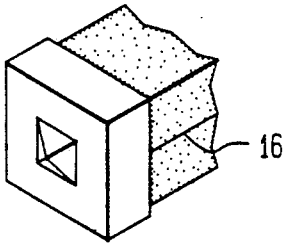
Figure 16C:
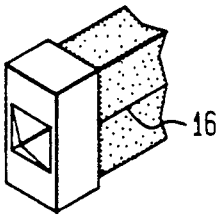
Figure 17A:
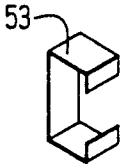
FIGS. 17*a*–17*d* and 18 show typical collars which may be utilized along any point of the window treatment for decoration purposes, as well as their positionings on the form.
Figure 17B:
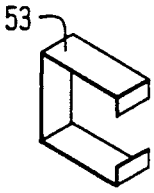
Figure 17C:
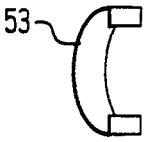
Figure 17D:
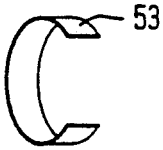

FIGS. 10–12 illustrate two decorative attachments 47, both top and front views, as understood, and a manner of securement into the flat plate 24 of the stake 20 to finish off the end of the form 10 after it has been covered with fabric. As will be seen, the stake 20 secures the fabric in place at the slot 18 (where the fabric is tucked) and the ornament 47 thus becomes the decorative end piece.

In like manner, a cap 51 can be employed to finish off the ends of the forms, made of a brass or chrome for example, where desired. Here, with the end treatment 51 fitting over the end of the form 10, the stake 20, along with its ornament 47 can be inserted through a slot in the end cap into the foam, thus securing the end cap in place. Such end caps 51 are shown in FIGS. 13–16 for forms that are of circular, semi-circular, square and rectangular cross-sections, respectively. Where two forms are to be connected in the manner shown as in FIG. 3, only end caps are employed at the remote ends of the joined combination.

Figure 18:
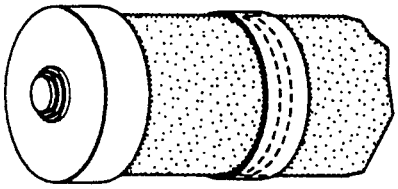

As will be also appreciated by those skilled in the art, other decorations might be desired. Thus, in FIG. 17 the collars 53 there shown may be employed to work with rectangular, square, circular and semi-circular forms (progressing clockwise from left-to-right in the drawing), to be positioned over any gap that is created when two forms are connected (FIG. 18).

As will also be appreciated, additional shapes can be had for the forms to be utilized in the window treatment, merely through a cutting, or slicing, of the foam-shape provided. Thus, such well-known shapes as discs, arches, blocks, bricks, wedges, spheres, domes and quadrants—as utilized in creating window treatments, can be made by cutting square, rectangular, circular and semi-circular foams as desired. Thus, it becomes quite possible for one to arrive at a multiplicity of designs, created according to one's imagination, without any need for sewing of fabrics into position, and which could then be easily disassembled for re-covering with desired fabrics, wallpapers, vertical vane materials and/or flat window shade fabrics, as desired. The arrangements can be done anywhere, and almost by anyone, and with the only tools required being a scissor for cutting the fabric, and knife for cutting the length desired, and a screwdriver to complete the installation. As will be appreciated, the coverage, assembly and installation are all exceedingly simple to construct.

While there have been described what are considered to be preferred embodiments of the present invention, it will be readily appreciated that modifications can be made by those skilled in the art without departing from the scope of the teachings herein. Thus, while a cross-shaped slot 18 has been described for accepting the stake 20, any other shaped slot can be employed, as long as it will accept the configuration of the stake 20 which can join adjacent forms together. In similar fashion, while the slot 18 is described as running along the entire length of the foam 12, it will be seen that in an actual construction, all that is necessary is that there be sufficient space at the ends of the foam to accept the tuck of the fabric 14. Having the slot 18 run the entire length, however, offers the advantage that where it is desired to cut the form to meet a particular length desired, there will always be present a slot at the end of the cut foam to receive the fabric tuck and the stake which facilitates holding it in place and joining the form to an adjacent section. All these will be seen to be within the scope of the teachings of the invention, and for such reasons, therefore, resort should be had to the claims appended hereto for a true understanding of the scope of the invention.

I claim:

1. Apparatus comprising:

a first elongated semi-soft foam of predetermined shape and dimension;

a straight-slit in an exterior surface of said foam running along the length of said foam;

a slot at least at one end of said foam; and a fabric covering wrapped around said foam, having opposing ends fitted into said slit and opposing sides tucked into said slot.

2. The apparatus of claim 1 wherein said slit is of an opening to accept said opposing ends of said fabric in a close fit.

3. The apparatus of claim 1 wherein said slot runs along the entire length of said foam.

4. The apparatus of claim 1 wherein said slot is positioned at least at each end of said foam along a central axis thereof.

5. The apparatus of claim 1 wherein said slot runs along the entire length of said foam, along a central axis thereof.

6. The apparatus of claim 1 wherein the shape of said foam is one of square, rectangular, circular and semi-circular cross-section.

7. The apparatus of claim 1 wherein said semi-soft foam is composed of polyethylene.

8. The apparatus of claim 1 wherein said semi-soft foam is composed of a packaging polyethylene foam.

9. The apparatus of claim 1 wherein there is also included:

a second semi-soft foam of predetermined shape and dimension;

a straight-slit in an exterior surface of said second foam running along the length of said foam;

a slot at least at one end of said second foam; and a fabric covering wrapped around said second foam, having opposing ends fitted into said slit and opposing sides tucked into said slot;

and means coupled between said slot on said first and second foams for joining said foams together.

10. The apparatus of claim 9 wherein said slots on said first and second foams run along the entire lengths of said foams, along a central axis thereof, and wherein said slots are cross-shaped in section.

11. Apparatus comprising:

a first elongated semi-soft foam of predetermined shape and dimension;

a straight-slit in an exterior surface of said foam running along the length of said foam;

a slot running along the entire length of said foam along a central axis thereof;

a fabric covering wrapped around said foam, having opposing ends fitted into said slit and opposing sides tucked into said slot; and wherein said slit is of an opening to accept said opposing ends of said fabric in a close fit.

12. Apparatus comprising:

a first elongated semi-soft foam of predetermined shape and dimension;

a straight-slit in an exterior surface of said foam running along the length of said foam;

a slot running along the entire length of said foam along a central axis thereof;

a fabric covering wrapped around said foam, having opposing ends fitted into said slit and opposing sides tucked into said slot;

a second semi-soft foam of predetermined shape and dimension;

a straight-slit in an exterior surface of said second foam running along the length of said foam;

a slot running along the entire length of said second foam along a central axis thereof;

a fabric covering wrapped around said second foam, having opposing ends fitted into said slit and opposing sides tucked into said slot;

means coupled between said slots of said first and second foams for joining said foams together; and wherein said slits of said first and second foams are of an opening to accept said opposing ends of said fabrics in close fit.

* * * * *